United States Patent [19]

Rewitzer

[11] 4,408,438

[45] Oct. 11, 1983

[54] PROCESS AND APPARATUS FOR PRESSING, PACKING AND HOOPING FIBROUS MATERIAL IN BALE FORM

[75] Inventor: Siegfried Rewitzer, Ihrlerstein, Fed. Rep. of Germany

[73] Assignee: Hoechst Aktiengesellschaft, Frankfurt am Main, Fed. Rep. of Germany

[21] Appl. No.: 210,372

[22] Filed: Nov. 26, 1980

[30] Foreign Application Priority Data

Nov. 30, 1979 [DE] Fed. Rep. of Germany ..... 2948237

[51] Int. Cl.[3] ..... B65B 63/02

[52] U.S. Cl. ..... 53/438; 53/399; 53/439; 53/528; 53/529; 53/589; 100/3; 100/295

[58] Field of Search ..... 53/438, 439, 436, 529, 53/528, 527, 523, 399, 589, 590; 100/3, 181, 295, 224, 219

[56] References Cited

U.S. PATENT DOCUMENTS

| | | | |
|---|---|---|---|
| 2,567,052 | 9/1951 | Carruthers | 53/438 X |
| 2,728,287 | 12/1955 | Tillinghast | 100/219 |
| 2,984,176 | 5/1961 | Sommer et al. | 100/295 UX |
| 3,228,166 | 1/1966 | Thiele | 53/438 |
| 3,541,948 | 11/1970 | Sauer et al. | 100/3 |
| 3,733,769 | 5/1973 | Van Doorn | 53/438 X |
| 3,958,392 | 5/1976 | Beninger | 53/438 |
| 4,162,603 | 7/1979 | Strömberg | 53/438 |
| 4,324,176 | 4/1982 | McCormick | 100/3 |

*Primary Examiner*—James F. Coan

*Attorney, Agent, or Firm*—Curtis, Morris & Safford

[57] ABSTRACT

The invention relates to a process and to apparatus for packing fibrous material in bales of high density, the material being pressed together in a final press and then being moved, together with the press-ram end piece and bottom plate, while still standing under pressure, out of the press compartment to further working positions where it is packed and reinforced.

The invention enables the bales to be packed outside the press compartment which can be already fed, during the packing operation, with new material to be pressed.

11 Claims, 5 Drawing Figures

PROCESS AND APPARATUS FOR PRESSING, PACKING AND HOOPING FIBROUS MATERIAL IN BALE FORM

The invention relates to a process and to apparatus for packing fibrous material in bales of high density by pressing and sheathing the resulting bales with sheet-like packing material and reinforcing bands or the like, the packing and reinforcing of the bales produced being effected outside the main press.

It is known, for example from German Offenlegungsschrift No. 2,736,316, further to compress in a box press cable tows which are deposited in a box sack made of packing material. According to this prior art, the packing in bale form is effected in the actual press compartment without opening the side walls of the press. A disadvantage of this process is the obligatory use of prefabricated fittings of packing material in box form as well as the blocking of the press during the actual packing operation and the hooping or reinforcement.

It has been known for a long time to collect staple fibers in so-called rotary presses, to press them in several stages and to pack them in the main press part. For this reason, the side parts of the press box are designed as doors which can be opened for the introduction of packing material and for reinforcing. Such rotary presses necessitate a high outlay on operating personnel, since it is necessary to introduce the packing material and, generally, also attach the reinforcing bands, by hand. Consequently, there has been no lack of proposals to have the packing and reinforcing of the bales carried out automatically. Corresponding apparatus is described, for example, in German Offenlegungsschrift No. 2,534,282. As may be seen from this Offenlegungsschrift, this apparatus requires exceptional technical effort. This effort bears no relation to the benefit which can be obtained with such apparatus, since, because of the rigid combination with a prepress part, this prepress generally determines the time of the work cycle of the main press. This determination of the time of the working rhythm by the prepress can be nullified in exceptional cases, namely when the rotary press used is connected to a very large fiber production line. In this special case, the necessary station time for the final pressing and the subsequent packing and hooping determines the work-cycle time. In this case, a further increase in output would be possible only by transferring the packing and reinforcing out of the actual press compartment. A solution of this problem is not indicated in the abovementioned Offenlegungsschrift.

It has already been proposed in German Offenlegungsschrift No. 2,911,958 to combine several prepresses with one main press. The fibrous material to be packed, that is to say, tows or flocks of staple fibers, is first to be deposited, in depositing or prepress systems, in press boxes which are then transported to a main or central press in which the final pressing of the material to be packed is carried out. Such a system, consisting of several prepresses, devices for laying down and prepression of tows and a central press justifies the use of a mechanical packing and reinforcing or hooping of the bales produced. The efficiency of the central press is then influenced only by the working speed in the individual operations within this central press, but is independent of the incidence on a production line of material which is collected in a prepress.

In the central press according to German Offenlegungsschrift No. 2,911,958 the packing and reinforcing can be effected automatically, but during this time the bale must remain in the main press and, during the packing time, the main press is not available for pressing further precompressed material. As stated above, this loss of time can arise, in exceptional cases, even in the operation of combined prepresses and final presses, namely when the incidence of material is so high that the station time for the final pressing and for packing and reinforcing determines the working rhythm of the press.

The object was, therefore, generally to increase the efficiency of the final stage of a multi-stage pressing of fibrous material into bales and to make a subsequent packing and hooping more efficient, that is to say, to carry out the steps for packing and reinforcing outside the pressing region of the final press.

Such an organization is already described, for example, in German Offenlegungsschrift No. 2,819,807. Here, after the final pressing, the bale produced is relieved again, so that the compression material is alowed a considerable increase in volume. The material thus relieved is discharged through a closable opening of the press compartment and is subsequently packed and hooped, while the substantially lowered pressure is maintained by guidance between conveyor belts or the like. The packing of bales outside the pressing region of the main press, as described in German Offenlegungsschrift No. 2,819,807, has a series of disadvantages. Reference may be made, for example, to the enforced increase in volume of the compressed material before it is received into the packing apparatus. On the other hand, such apparatus is not suitable for packing cable tows in bales of high density.

The object was, therefore, still to find a process and suitable apparatus which make it possible to convey out of the pressing region, without appreciable increase in volume, fibrous material pressed in a final press and to pack this, outside the final press, with sheet-like flexible packing material and hoop it with reinforcing wires or bands.

It has been possible to achieve the stated object by means of a process according to patent claim 1. Firstly, the pressing faces of the press-ram and of the bottom plate of the press are covered with blanks of a flexible sheet-like packing material which project beyond the actual pressing faces, thereafter the already precompressed fibrous material is introduced, the introduction into the press being effected, for example, together with the press box. After the actual pressing operation has been carried out, the side walls of the press box of the press must be removed at least so far from the fibrous material, which continues to stand under the applied pressure, that it is possible for a holding device to receive the pressed bale together with bottom plate and an end piece of the press-ram. The press-ram end piece should preferably have the size of the total pressing face. The pressed bale together with press-ram end piece and bottom plate must be received by a holding device in such a way that at most a slight increase in volume of the pressed material is allowed to occur. In so doing, the holding device must be guided on a predetermined path which enables the pressed bale to be moved out of the pressing region of the final press to various further working positions outside the final press. In such a further working position the projecting areas of the packing material blanks on the pressing faces of the bottom plate and of the press-ram end piece are bent onto the side faces of the bale by means of preferably mechanically operating turning-down or holding-down devices and are held in this position. If the areas of packing material which project beyond the pressing faces are not sufficient for a complete overlapping sheathing of the side faces of the bale, then a sheet of flexible packing material is wrapped round the side faces preferably by means of a suitable device and is held in this position, for example, by stitching, welding or clamping. The bale thus sheathed with packing material is subsequently brought to a further working position by means of the holding device, in which position the bale is reinforced by hooping with wire or bands by means of known hooping devices. The holding device is subsequently opened to release the bale. By this opening, the spacing between the press-ram end piece and the bottom plate is enlarged until the bale can be ejected to be transported away. The press-ram end piece and bottom plate are subsequently moved by means of the holding device to a further working position in which the pressing faces of these two parts are covered with sheet-like packing material blanks. The pressing faces of the bottom plate and of the press-ram end piece must have suitable devices to hold these packing material blanks. The cycle ends with the transfer of the bottom plate and of the press-ram end piece into the final press where the press-ram end piece is united again with the upper part of the press-ram and is interlocked therewith and fixing devices ensure that the bottom plate is positioned correctly in the pressing region.

It is absolutely essential that at least two holding devices working independently of one another and a corresponding number of pairs of bottom plates and press-ram end pieces are present, in order to bring about the increase in efficiency of the process according to the invention.

To carry out the process, apparatus according to the invention is required, whose essential components and features are specified in the main apparatus claim. According to this, the apparatus according to the invention comprises a bale press to which at least two releasable end pieces of the press ram and at least two movable bottom plates belong. A pair consisting of a press-ram end piece and a bottom plate is in common use at any given time. The end pieces of the press-ram and the bottom plates have conventional tying grooves for hooping and have packing material holding devices for holding packing material blanks which project beyond the actual pressing faces.

The releasable end pieces of the press-ram which have, at least in the working direction, the full dimensions of the pressing face required, are provided with interlocking devices which guarantee a fixed connection of such a releasable press-ram end piece to the associated upper part of the press-ram.

To prevent displacement of the movable bottom plate during the pressing operation, suitable fixing devices must be provided, for example at the foot of the press, to guarantee a definite positioning of the bottom plate.

The bale press must have at least one press container whose side walls constitute the press compartment of the bale press. These side walls are connected to operating mechanisms which, on the one hand, guarantee a fixing of the position of the side walls in the pressing position during the pressing operation, but, on the other hand, also permit at least partial removal of the side walls, after the pressing operation, out of the region of the pressed material including press-ram and bottom plate. The side walls must be removed at least so far that it is possible for a holding device to receive the pressed bale incuding bottom plate and press-ram end piece. This can be effected, for example, by virtue of the fact that the press box has the form of an open cylinder of rectangular cross-section, which can be moved completely away from the fibrous material including bottom plate and press-ram end piece by means of the operating mechanisms. A further possibility is, for example, that the side walls of the press box are connected to one another by means of hinges and closing devices. Such a device enables the side walls of the press box to be removed sideways by opening the closing devices and subsequently swinging open the side walls.

The apparatus according to the invention also includes at least two holding devices which can be moved on predetermined paths between different working positions and the pressing region of the bale press and which each have grabbing devices to receive the bale in the pressed state and, indeed, inclusive of the press-ram end piece and optionally also the bottom plate, provided that this bottom plate is not part of the actual holding device. When the pressed material is received by the holding device, it is necessary to ensure that the pressed volume of the pressed material does not increase or increases at most only slightly, that is to say, the holding device must be of such a sturdy construction that, after reception by the holding device, unlocking of the interlocking devices on the upper part of the press-ram and retraction of the press-ram with its upper part, the releasable end piece of the press-ram is held by the holding device alone and the applied pressure on the pressed material is substantially maintained. The increase in pressed height of the bale during this receiving operation should be at most only 50 mm and these values should preferably lie below 30 mm. Only if this requirement is satisfied is it possible to obtain pressed bales with a very high volumetric density. Furthermore, this measure is indispensable in the final pressing of already precompressed cable tows. In the packing of cable tows there results a distinctly poorer cohesion of the pressed material than in the packing of staple fibers. The view previously prevailed that in the pressing of cable tows in bale form it is absolutely essential to carry out the pressing and hooping in a closed box press to prevent the bales from breaking open laterally. Trials have now shown that this requirement does not necessarily have to be met, provided that it is ensured that the applied pressure or the pressed volume of such a bale of cable tows is not substantially varied during the packing operations. It is therefore possible also to pack cable tows which have been pressed into bales, with the press container or press box removed. Nor do receiving by a holding device and packing outside the actual pression region of the final press lead to disturbances, provided that the holding device ensures that the pressed volume does not substantially increase. Under these conditions it is also unnecessary to employ special fittings, for example in the form of box sacks, for the packing of cable insulating tapes.

The holding devices necessary according to the invention must have grabbing devices with which it is ensured that the releasable press-ram end piece is received securely. Furthermore, there must be provided on the holding devices mechanisms which enable the pressed material to be released. For this reason, it must be possible to vary the spacing between the bottom plate and press-ram end piece in the holding device.

In one working position of the holding devices it is necessary to provide folding-in and/or holding-down devices which enable the sheet-like packing blanks which project beyond the pressing face to be bent round and held down onto the side faces of the pressed bale in question. Such folding-in and holding-down devices have already been described several times; they can consist, for example, of a plurality of, for example, hydraulically operated fingers which bend the projecting packing material areas round onto the side faces of the bale.

If the dimensions of the projecting packing material areas are sufficient to cover the entire side faces with packing material in an overlapping manner, the reinforcement of the bale by means of known hooping or banding devices can be started immediately thereafter. Preferably, however, the side faces are further sheathed with a sheet of flexible packing material, this sheet being fixed in position on the pressed bale by welding, stitching, clamping or the like. The width of this sheet of flexible packing material, such as, for example, plastic film, strip film or jute fabric, should not exceed the height of the side faces of the bale, since otherwise the subsequent reinforcing of the bale can be hampered. After the bale has been sheathed by means of conventional sheathing devices and the sheet of packing material has been fixed in place, the holding-down devices for bending and fixing the packing blanks which project beyond the pressing faces can be retracted again and the bale is then conveyed by means of the holding device to a further working position where it is reinforced by means of hooping devices which preferably work automatically. After the reinforcing has been effected, the bale is ready packed and is released, to be transported away, by opening the holding device and consequently increasing the distance between the press-ram end piece and the bottom plate. In a further working position of the holding device, the pressing faces of the press-ram end piece and of the associated bottom plate which are now free of the pressed material are covered with blanks of packing material. These blanks of packing material are held in place, during further transport back into the bale press, by means of the packing-material holding devices which are provided on the press-ram end piece and on the bottom plate. Such holding devices can be, for example, a plurality of suction cups, as are used, for example, in the conveyance of individual sheets of paper, or else corresponding clamping devices.

Protected in the sub-claims to the apparatus claim are special embodiments which are to be described in detail below in conjunction with the description of two special embodiments of the invention.

Described in FIGS. 1 to 4 is a preferred embodiment of the claimed final press for packing and hooping (or bonding) fibrous material in bale form, in which the holding devices and the movable bottom plates are mounted so as to be rotatable on a common vertical shaft.

FIG. 1 shows a schematic plan view of such apparatus, while

Figure 1:
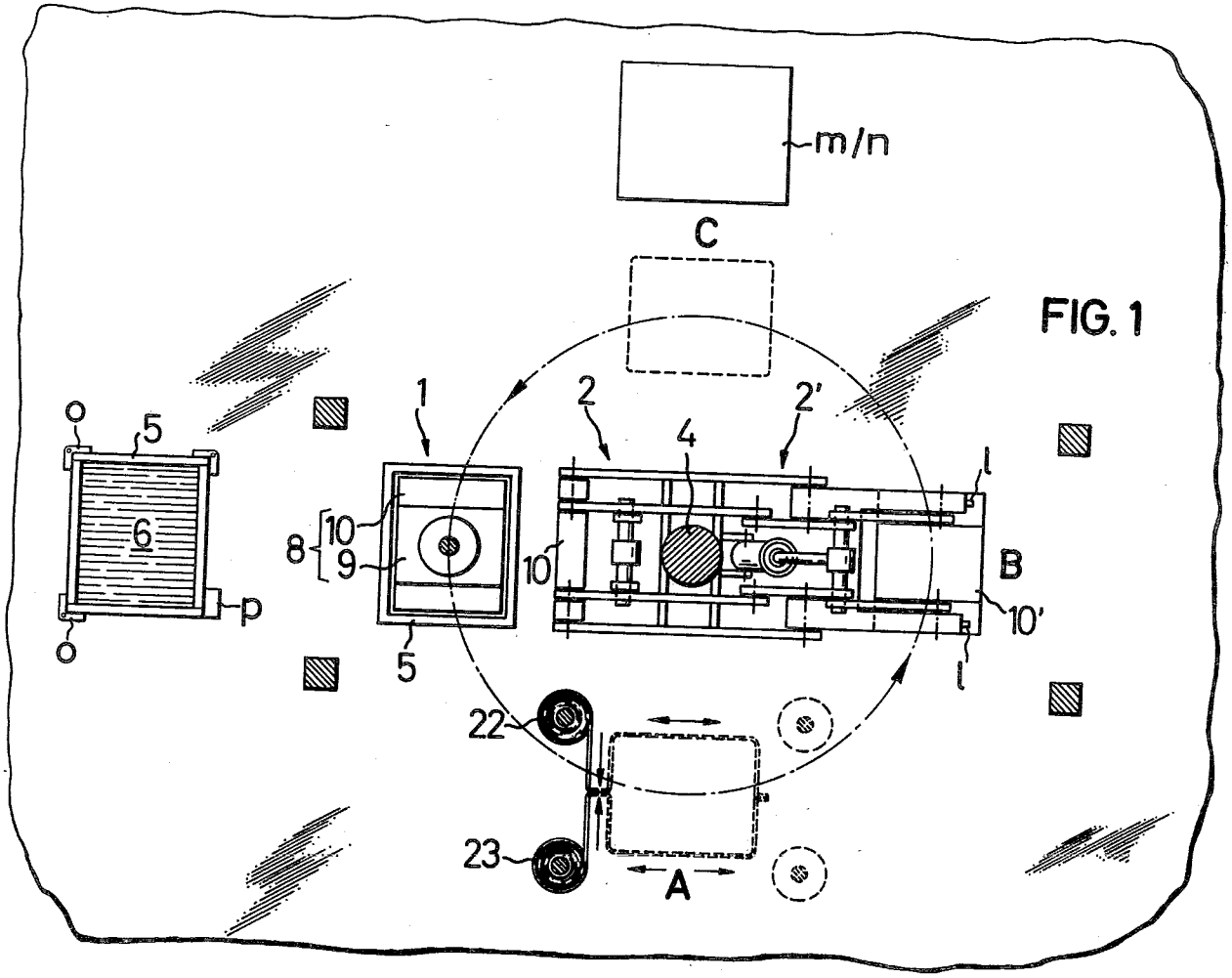

FIG. 1 shows in a plan view the spatial arrangement of the final press (1) with two holding devices (2,2') which are mounted so as to be rotatable, together with the associated bottom plates (3,3'), on a common shaft (4). In this embodiment, the precompressed or prepressed fibrous material (6) which is supplied in a transportable press box (5) is first subjected to a final pressing in the press. The material thus compressed has been denoted by (7).

It can be seen from FIG. 1 that the holding devices (2,2') can engage into the pressing region of the final press (1), but can also be moved into different working positions A, B and C by turning the holding device (2) and the associated bottom plate (3) about the shaft (4). In the working position A, the blanks of packing material which project beyond the pressing faces are bent over by means of holding-down devices and the sheathing with a sheet of flexible packing material is effected. In the working position B, the bale is to be reinforced by means of bands or wires and the ready-packed bale is to be ejected, while, in position C, the pressing faces of the press-ram end piece and of the bottom plate are covered with blanks of packing material.

Figure 2:
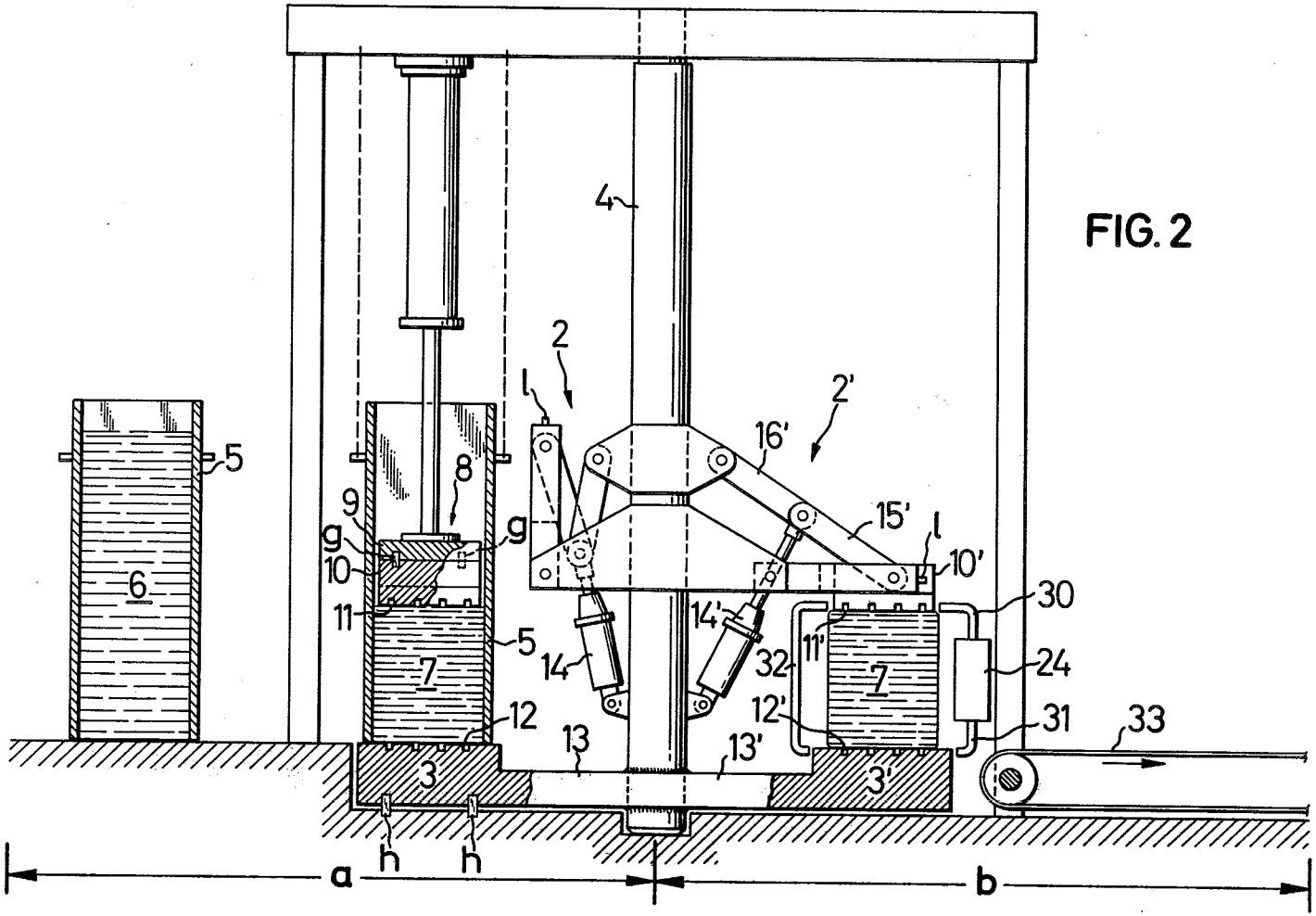
FIGS. 2 to 4 illustrate in side views the individual working steps of this apparatus.
Figure 3:
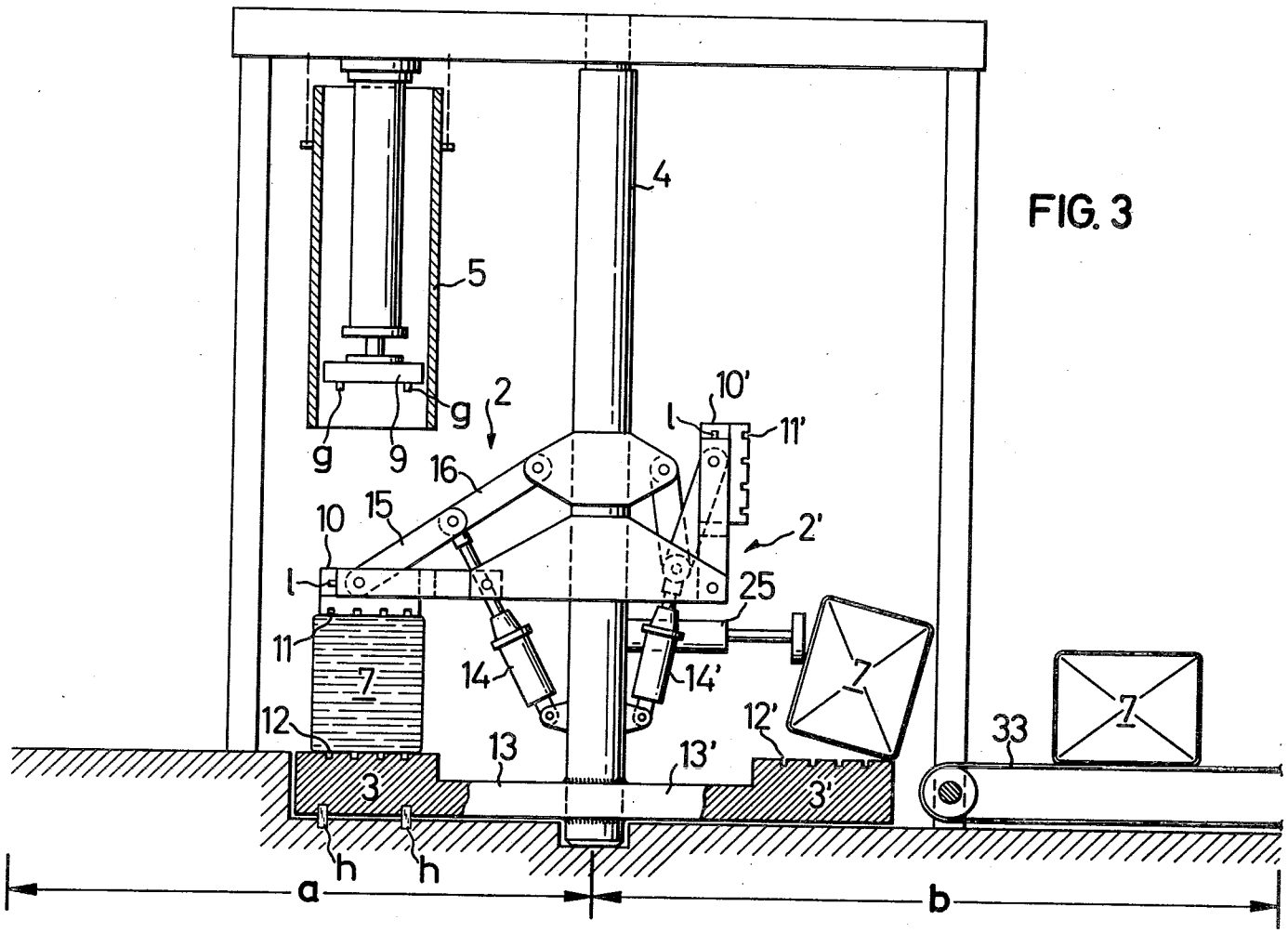
Figure 4:
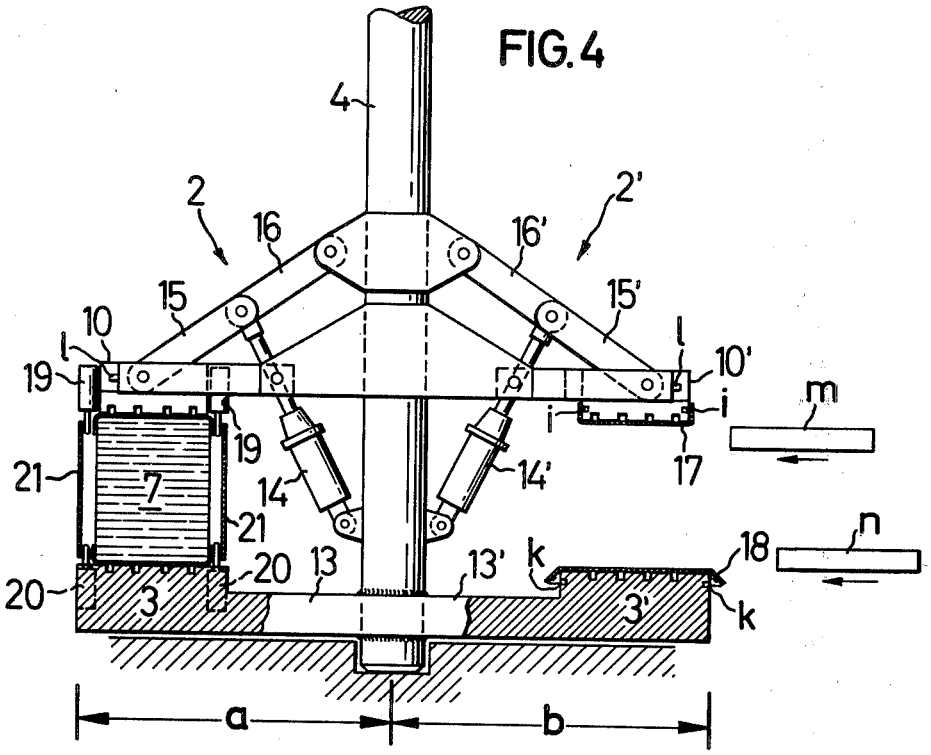

The actual progress of the working steps of this apparatus is to be seen from the side views of FIGS. 2 to 4. In these figures, partial cross-sections are shown, if this is advantageous for clarity. Likewise, apparatus parts not belonging directly to the working steps illustrated have been omitted.

In the left-hand section of FIG. 2 (referred to below as 2*a*) the final pressing of the fibrous material is represented. The precompressed material is located in a press box (5) and is pressed together by means of a hydraulically operated press-ram (8). The press-ram consists of a press-ram upper part (9) which is connected by interlocking devices (g) to the press-ram end piece (10). This press-ram end piece (10) has, like the bottom plate (3), longitudinal and optionally also transverse grooves (11,12) which are required for the subsequent reinforcement of the bale by means of hooping devices. The holding device (2) for the releasable press-ram end piece (10) is not in a working position during the pressing operation. The bottom plate (3) is connected via the crossbar (13) to the vertical shaft (4). The exact positioning of this movable bottom plate is effected by means of fixing devices (h), which engage either into the bottom plate (3) in this position or else into the crossbar (13).

In the embodiment illustrated in FIGS. 1 to 4, two holding devices (2 and 2') together with the associated movable bottom plates (3 and 3') are firmly fastened to a vertical shaft (4), that is to say, in this embodiment, the bottom plates (3 and 3') are either in the pressing position and working position B or, after turning the shaft through 90°, in the working positions A and C. The working position B is represented in the right-hand section of FIG. 2. For the sake of clarity, this part of FIG. 2 (referred to below as 2*b*) will not be described until later.

FIG. 3 illustrates the same position of the shaft (4) with the holding devices (2 and 2') connected thereto and with the bottom plates (3 and 3'). In the left-hand section of FIG. 3 (referred to below as 3*a*) the pressing operation has already ended, the press box (5) has been moved away upwards by means of operating mechanisms not shown, with retention of the applied pressure of the press-ram, and the holding device (2) has been brought into the receiving position by operating the hydraulic drive (14). After grabbing devices (1) have been actuated, the press-ram end piece (10) is now carried by the lever arm system (15,16), so that the press-ram upper part (9) can be retracted after releasing the interlocking devices not shown. The lever system (15,16) with the corresponding connecting bolts and bearings must be of such sturdy construction that it is capable of keeping the pressed material (7) in its final pressed state practically without allowing further vertical expansion. The hydraulic drive (14) must be designed so that the lever system (15,16) is reliably prevented from rupturing or buckling. Likewise, the crossbar (13) must be designed so that no appreciable bending of this part occurs under the applied pressure.

In FIG. 4, a turning of the shaft (4) together with the holding devices (2,2') connected thereto and with the bottom plates (3,3') has taken place. The working position A (sheathing) is represented schematically in the left-hand section of this figure. In this operation, the blanks of packing material (17 and 18) which are already located during the pressing operation on the pressing faces of the press-ram end piece (10) and the bottom plate (3) are bent, for example by pneumatically driven holding-down devices (19,20), and are held in this position. Subsequently, the side faces of the bale are sheathed by means of a sheet of packing material (21). The associated sheathing device is suggested schematically in FIG. 1 in the working position A. Two sheets of packing film which are drawn off from the supply rolls (22 and 23) are used here. These sheets are welded to one another at their ends. The sheathing is effected by moving the supply rolls (22 and 23) past the bale. After they have passed the bale, the sheets are brought together by clamping devices not shown and are joined together with two welding seams. Between these two welding seams a separation is effected by means of a cutter not shown. When the holding devices are pivoted further from working position A to position B, the rolls are returned to their original position and are available for a new packing operation. Because the side faces of the bale are sheathed by means of a sheet of packing material (21), a further holding down of the projecting packing material areas by the holding-down devices (19,20) is no longer necessary. These can be withdrawn and the bale transported further to working position B.

The working position B is represented in FIG. 2*b*. The bale is reinforced here by means of an automatic hooping or bonding device (24) which works together with the guide devices (30,31,32) and the tying grooves (11' and 12'). FIG. 2*b* illustrates the second holding device in which a bale is brought into the hooping position. This second holding device as well as the other associated parts are identical to the first holding device illustrated on the left-hand side, but they bear a (') as additional identification in order to distinguish them. After the hooping has been carried out according to FIG. 2*b*, the holding device (2') is then released by operating the hydraulic drive (14'). The press-ram end piece (10') is thereby lifted and the bale is ready to be transported away.

This transporting away is illustrated in FIG. 3*b*. An ejector (25) moves the bale onto a conveyor belt (33) which takes over the further transportation of the bale.

After the holding devices have been turned through 90° about the shaft (4), the holding device considered hitherto reaches the working position C according to FIG. 4*b*. In this working position, the lever system (15',16') of the holding device (2') is appropriately extended again by actuating the hydraulic drive (14') and, in this position, the pressing faces of the press-ram end piece (10') and of the movable bottom plate (3') are covered with blanks of packing material. This covering can be effected by means of known covering devices (m,n) which are shown in FIGS. 1 and 4.

The blanks of packing material on the pressing faces are held against the press-ram end piece (10') and the bottom plate (3') by means of suitable holding devices (i,k). This holding can be effected, for example, by suction cups connected to a vacuum system or else by clamping devices connected eg. to the side faces (i) of the press-ram end piece (10') and (k) of the bottom plate (3') which adjoin the actual pressing faces. The press-ram end piece (10') and bottom plate (3') are thus available for a new pressing operation, that is to say, after a further turning of the holding device and of the bottom plate through 90° about the shaft (4), the bottom plate (3') is situated again in the pressing position, while the press-ram end piece (10') can be received by the press-ram upper part (9), the holding device (2') releasing the press-ram end piece (10').

It is possible, without further ado, to use, instead of the two holding devices shown in FIGS. 1 to 4, also several holding devices of this type. In this case, however, it is necessary to relinquish a rigid connection of the holding devices (2 and 2') and of the bottom plates (3 and 3') to the shaft (4), instead of which it is necessary to ensure by means of suitable connecting braces that, for example, the holding device (2) always remains assigned to the associated bottom plate (3).

In a favorable arrangement, the sidewalls of the press box (5) can be hinged together by means of hinges (o) and closing devices (p) as shown diagrammatically in FIG. 1.

Figure 5:
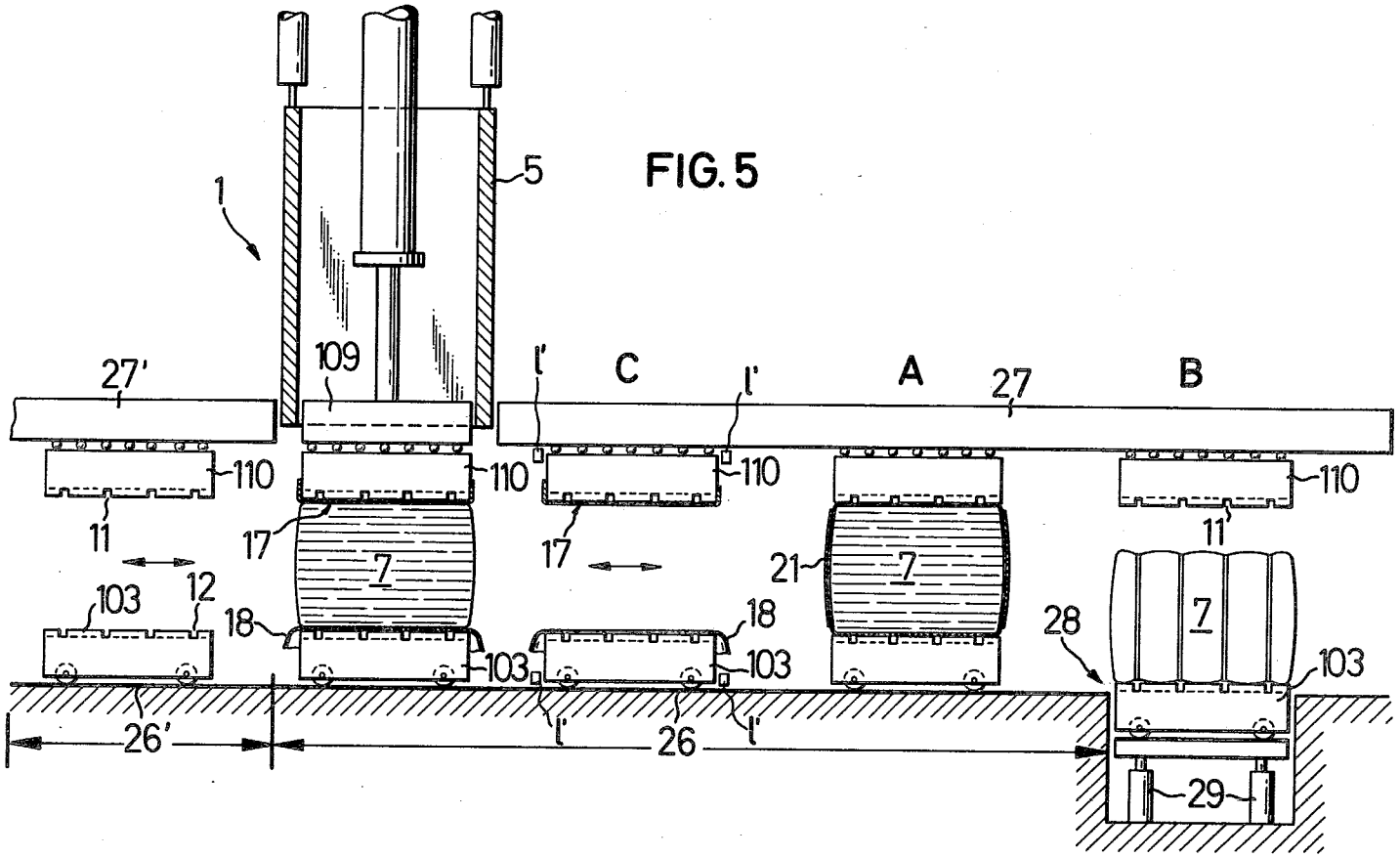
FIG. 5 is a side view of another preferred embodiment of the invention.

Another embodiment of the apparatus according to the invention is illustrated in a schematic side view in FIG. 5. As with the above-described embodiment, the precompressed fibrous material is further compressed in a final press (1). The press-ram is, again, divided into a press-ram upper part (109) and a releasable press-ram end piece (110), which are connected to one another during the pressing operation by interlocking devices not shown. In this embodiment, the movable bottom plate (103) is guided, for example via rolls or rollers, on a lower rail track (26,26'). The exact positioning of the bottom plate (103) during the pressing operation is effected by fixing devices not shown. In FIG. 5, the bale final press has already executed the actual pressing operation, the fibrous material is in its final pressed state (7), while the transportable press box has been moved away from the pressed material including bottom plate (103) and press-ram end piece (110) by means of operating mechanisms. In this embodiment, the holding devices consist of the lower rail track (26,26') and an upper rail track (27,27') and of a lowering device (28) for the lower rail track which can be moved via a hydraulic drive (29). Furthermore, there belong thereto roller, slide or rail guides, only suggested in the drawing, which permit a movement of the bottom plate (103) and of the press-ram end piece (110) in the rail tracks (26,26') and (27,27') and in the upper part of the press-ram (109). Furthermore, operating mechanisms are to be provided, which enable the bottom plate (103), the press-ram end piece (110) and the pressed fibrous material (7) to be moved simultaneously and synchronously along the rail tracks (26,27) or (26',27').

Provided along the rail tracks (26,27), which here fulfil the function of the holding device, are special working positions A, B and C, in which the ready-pressed bale is finally packed with packing material substantially still under its original applied pressure and is reinforced with bands or wires and, subsequently, the free pressing faces are covered again with pieces of packing material. In position A, the sheathing with a sheet (21) of packing material has already been effected and, in position B, a bale is shown, which has already been hooped and where, by lowering by means of the hydraulic drive (29), the spacing between the bottom plate (103) and the press-ram end piece (110) has been enlarged until the bale can be transported away. Upon the return of the parts (103 and 110) within the rail track (26,27), a further position C is provided, in which the pressing faces of the bottom plate (103) and of the press-ram end piece (110) are covered with blanks of packed material (17,18) by means of known devices. The bottom plate (103) and the press-ram end piece (110) must have corresponding grabbing devices (1') to hold the blanks of packing material in place.

With this apparatus, also, it is necessary to employ at least two holding devices and two sets of bottom plates and press-ram end pieces, in order to achieve the desired increase in efficiency of the final press. Suggested in FIG. 5 is a second holding device, that is to say, a further lower and upper rail track (26',27'), in which the same devices are to be provided as were described in the right-hand section of the drawing.

I claim:

1. Process for pressing fibrous material in bale form in a final press and for subsequently packing and hooping these bales, comprising the steps of (a) covering pressing faces of a press-ram and of a bottom plate of the final press with blanks of flexible sheet-like packing material which project beyond the pressing faces and are held in this position, and thereafter introducing already prepressed fibrous material into the final press between said blanks and pressing the material;

(b) after the pressing operation, removing side walls of a press box of the press from the fibrous material, while the press maintains the bale of material under applied pressure, far enough to enable a holding device to receive the pressed bale including the end piece of the press-ram and the bottom plate;

(c) receiving the pressed bale including the press-ram end piece and bottom plate by means of the holding device and moving the same on a predetermined path out of the pressing region to further working positions, with the pressed height of the bale being allowed to increase at most slightly;

(d) subsequently automatically bending projecting areas of the blanks of packing material onto the side faces of the bale by means of holding-down or turning-in devices and holding the bent-down areas in this position;

(e) then reinforcing the bale with hooping means;

(f) subsequently, by opening the holding device, increasing the distance between the press-ram end piece and bottom plate so that the bale is released to be transported away; and (g) returning the press-ram end piece and bottom plate thereafter into the pressing region by means of the holding device.

2. The process according to claim 1, further comprising, after the step of bending the projecting areas of the blanks of packing material onto the side faces of the bale, sheathing the side faces of the bale with a sheet of flexible packing material.

3. The process according to claim 1, wherein the pressing faces of the press-ram and of the bottom plate are already covered with blanks of packing material outside the pressing region of the press, when the press-ram end piece and bottom plate are returned by the holding device, and are held in this position.

4. The process according to claim 1, wherein the final press is equipped with more than two sets of press-ram end pieces and bottom plates and with more than two holding devices, each holding device being capable of moving a pressed bale on a predetermined path out of the pressing region to further working positions and of returning the press-ram end piece and associated bottom plate into the pressing region after ejection of the bale.

5. Apparatus for pressing fibrous material in bale form and for subsequently packing and hooping these bales, comprising (a) a bale press including a press ram with at least two releasable end pieces of the press ram and with at least two movable bottom plates which each have tying grooves for hooping and which each have packing-material holding devices to hold blanks of packing material which project beyond the pressing faces, (b) interlocking devices on the upper part of the press-ram which ensure a fixed connection of the releasable end piece to the upper part of the press-ram, (c) fixing devices at the foot of the bale press for positioning the movable bottom plate in the pressing region of the bale press during a pressing operation, (d) at least one press box whose side walls represent the press compartment of the bale press and which are connected to operating mechanisms which enable the position of the side walls to be fixed in the pressing position during the pressing operation and enable the side walls to be removed, after the pressing operation, out of the region of the pressed material including the press-ram end piece and bottom plate.

(e) at least two bale holding devices which can be moved on predetermined paths between different working positions outside the bale press and the pressing region of the bale press and which each have grabbing devices to receive a pressed bale, and the associated press-ram end piece, as well as further devices which enable the pressed material to be released, (f) holding-down devices for bending and holding down onto the side faces of the bale the blanks of packing material which project beyond the pressing faces, these holding-down devices being arranged so that they act upon the bale, which is held in the holding device, in a working position outside the working region of the bale press, (g) hooping devices which enable the pressed bale to be reinforced by means of bands or wires in a further working position of the holding device, and (h) covering devices which enable the press-ram end piece and the bottom plate to be covered with blanks of packing material in a working position of the holding device after release of the bale.

6. The apparatus according to claim 5, wherein the holding device has the form of an (upper and a lower rail track in which the press-ram end piece and the associated bottom plate can be moved, simultaneously with the pressed material, without an appreciable increase in the pressed height, out of the press region to further working positions outside the bale press and in which the bale is released by lowering the lower rail track or raising the upper one.

7. The apparatus according to claim 5, wherein at least two holding devices and at least two bottom plates are fastened so as to be rotatable on a common vertical shaft which permits a common pivoting of the bale in the pressed state, together with the bottom plate and holding device of the press-ram end piece, out of the pressing region to various further working positions and wherein the grabbing devices on the holding devices are capable of holding the press-ram end pieces also when the bale is released and removed.

8. The apparatus according to claims 5, 6 or 7, wherein the press box has the form of an open cylinder of rectangular cross-section, which can be removed completely from the fibrous material including bottom plate and press-ram end piece by means of operating mechanisms.

9. The apparatus according to claims 5, 6 or 7, wherein the side walls of the press box of the bale press are connected to one another by hinges and closing devices which enable the side walls of the press box to be removed sideways, by opening the closing devices and swinging open the side walls, at least until the bale in the pressed state, including press-ram end piece and bottom plate, can be moved out of the pressing region.

10. The apparatus according to claim 5, further comprising sheathing means for effecting the sheathing of the side faces of the bale with a sheet of flexible packing material and the fixing of said sheet by fastening means.

11. The apparatus according to claim 10, wherein said fastening means is one of a group consisting of welding means, stitching means, and clamping means.

* * * * *